US005481802A

United States Patent [19]

Lembke

[11] Patent Number: 5,481,802

[45] Date of Patent: Jan. 9, 1996

[54] RAZOR HEAD, IN PARTICULAR A RAZOR BLADE UNIT OF A WET RAZOR

[75] Inventor: Max Lembke, Middlesex, Great Britain

[73] Assignee: Warner-Lambert Company, Morris Plains, N.J.

[21] Appl. No.: 185,437

[22] Filed: Jan. 21, 1994

[30] Foreign Application Priority Data

Jan. 21, 1993 [GB] United Kingdom ..... 9301/56

[51] Int. Cl.[6] ..... B26B 21/22

[52] U.S. Cl. ..... 30/50; 30/346.57

[58] Field of Search ..... 30/47–50, 346.57, 30/41, 41.5, 32

[56] References Cited

U.S. PATENT DOCUMENTS

| | | | |
|---|---|---|---|
| 4,069,580 | 1/1978 | Cartwright et al. | 30/47 |
| 4,845,848 | 7/1989 | Strickland | 30/49 |
| 4,875,287 | 10/1989 | Creasy et al. | 30/90 |
| 5,070,613 | 12/1991 | Althaus et al. | 30/50 |

FOREIGN PATENT DOCUMENTS

| | | |
|---|---|---|
| 0477132 | 3/1992 | European Pat. Off. . |
| 2447087 | 4/1975 | Germany . |
| 1180719 | 2/1970 | United Kingdom . |
| 1498640 | 1/1978 | United Kingdom . |
| 1589591 | 5/1981 | United Kingdom . |
| 2066132 | 7/1981 | United Kingdom . |
| 2171630 | 9/1986 | United Kingdom . |
| 2266486 | 11/1993 | United Kingdom . |

*Primary Examiner*—Douglas D. Watts
*Attorney, Agent, or Firm*—Robert W. Becker & Associates

[57] ABSTRACT

A razor head for a wet razor, and a method of making the same. The razor head, and in particular a razor blade unit, has at least one razor blade with a cutting edge, and at least one plastic part that is provided with at least one indentation which provides a well for the application of adhesive. The at least one plastic part and the at least one razor blade are secured together by the adhesive.

11 Claims, 5 Drawing Sheets

RAZOR HEAD, IN PARTICULAR A RAZOR BLADE UNIT OF A WET RAZOR

BACKGROUND OF THE INVENTION

The present invention relates to a razor head for a wet razor. The razor head is arranged at the front end of a handle and has a single or double razor blade arranged in a plastic housing having perforations and a front guardbar. The present invention also relates to a method of making such a razor head.

In conventional wet razors, a single or double razor blade is permanently embedded in a plastic housing in the razor head. If the razor head is constructed separately from the handle and is fastened to a handle by interlocking elements, the razor head is known as a razor blade unit.

A double or twin razor head typically comprises five components, namely a lower plastic part, a lower blade, a spacer, an upper blade and an upper plastic part, all arranged together in the form of a sandwich. These components are typically held together by means of plastic rivets which are formed on the upper plastic part and protrude through holes in the blades, spacer and lower plastic part. The razor heads are assembled automatically on a production line and are permanently fixed together by cold forming of the plastic rivets. This method has a number of disadvantages such as the requirement to perforate all the components, in particular the blades.

More recently it has been possible to secure the components together by means of an adhesive instead of rivets. This avoids the requirement of perforating all the components, which obviously saves additional processing operations and also leads to the use of blade steels with improved properties.

The method of assembly using adhesive comprises the steps of locating the lower plastic part in a suitable nest, applying the adhesive, positioning the lower blade and applying pressure, applying adhesive to the lower blade, positioning the spacer and applying pressure, applying adhesive to the spacer, positioning the upper blade and applying pressure, applying adhesive to the upper blade, and finally positioning the upper plastic part and applying pressure.

A disadvantage of this method is the large number of steps, which increases the cost of the production line and also increases the risk of stoppages on the line. Also, there are particular problems due to stoppages on the adhesive stage due to blockages in the adhesive applicator.

It is an object of the present invention to improve the method of production of a razor head, in particular in a razor blade unit of a wet razor.

A further object of the invention is to provide a razor head whose components are secured together by adhesive.

A further object of the invention is to provide a razor head which can be temporarily held together by detents or other friction fit.

A further objective of the invention is to provide a razor head for a wet razor comprising at least one razor blade having a cutting edge, and a plastic part for supporting said blade, whereby the plastic part comprises at least one indentation on its blade supporting surface which provides a well for the application of adhesive.

Further objectives and advantages will be apparent from the following description and claims.

SUMMARY OF THE INVENTION

To achieve these objectives, the invention provides a razor head whose components comprise grooves on the surface to permit the penetration of adhesive. This allows the razor head to be assembled initially without adhesive, with the adhesive then being applied in a single operation to the assembled razor head.

In addition, the assembled razor head is temporarily held together by detents or other suitable friction means so that the adhesive can be applied at a separate station. Such an arrangement prevents stoppages at the adhesive application stage from stopping the entire assembly line.

In the preferred embodiment, the invention provides V-shaped grooves or indentations on the upper surface of the lower plastic part, the lower and upper surfaces of the spacer, and also on the lower surface of the upper plastic part. The V-shaped groove provides a well for the adhesive and encourages penetration of the adhesive to the entire surface of the respective parts to be fixed together by the action of capillary forces.

In a further preferred embodiment of the invention the surfaces to be fixed together are left unmarked and the adhesive is selected with a sufficiently low viscosity to penetrate between the surfaces. Additionally, notches can be provided on the rear edges of the plastic components to provide wells for the adhesive when the adhesive is applied.

In a further preferred embodiment of the invention the surfaces of the parts to be fixed together comprise a toughened surface comprising micro grooves which permits the optimum penetration of adhesive by capillary forces to maximize the surface covered by the adhesive and to optimize the thickness of the adhesive to ensure that the required bonding strength is achieved.

In a further preferred embodiment of the invention the adhesive that is used has a viscosity which is such that the adhesive will penetrate between the surfaces of the components to be permanently fixed together to a sufficient extent and to a sufficient thickness before the adhesive sets.

It is to be understood that both this general description and the following detailed description are exemplary and explanatory only and are not restrictive of the invention as claimed.

BRIEF DESCRIPTION OF THE DRAWINGS

A razor head according to the invention will now be described in greater detail, by way of example only, with reference to the accompanying schematic drawings, in which.

DESCRIPTION OF PREFERRED EMBODIMENTS

Figure 1:
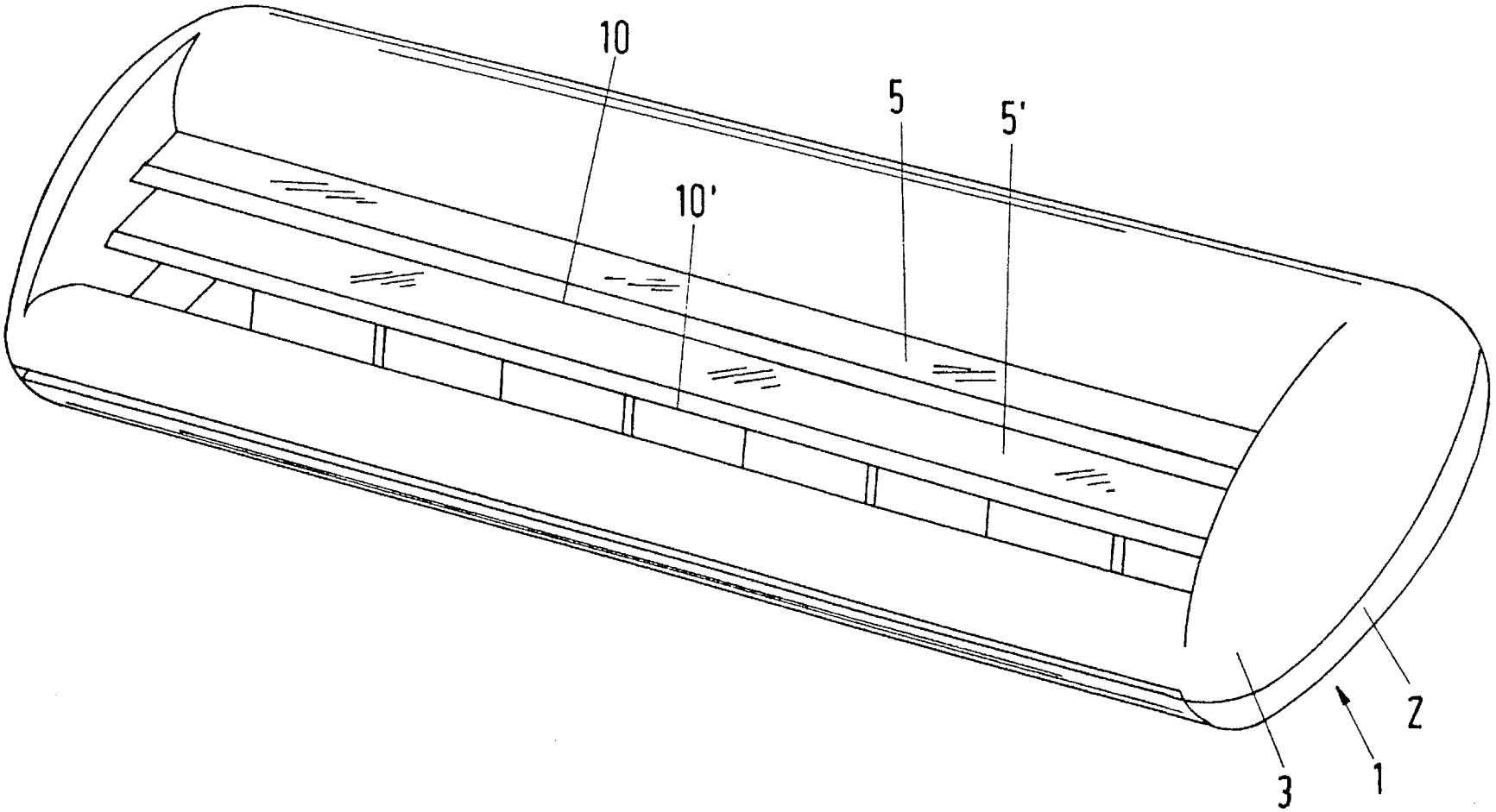
FIG. 1 is a perspective view of one exemplary embodiment of the inventive razor blade unit.

Referring now to the drawings in detail, the razor blade unit 1 includes a lower plastic part 2, an upper plastic part 3, a lower blade 5', an upper blade 5, such blades having respective blade edges 10' and 10, and a spacer 4.

Figure 2:
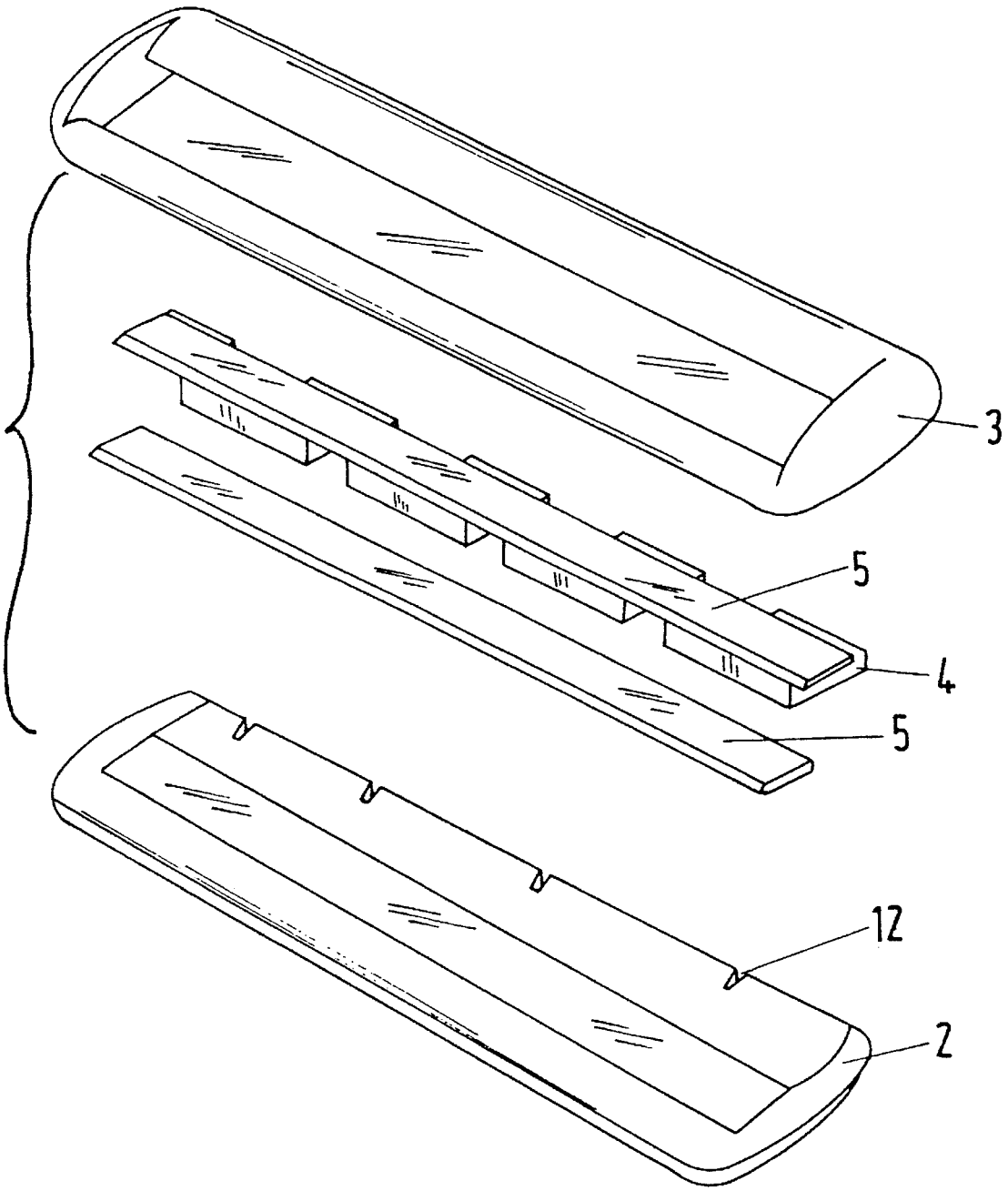
FIG. 2 is an exploded perspective view of the component parts of an inventive razor blade unit according to a first embodiment of the invention.
Figure 2A:
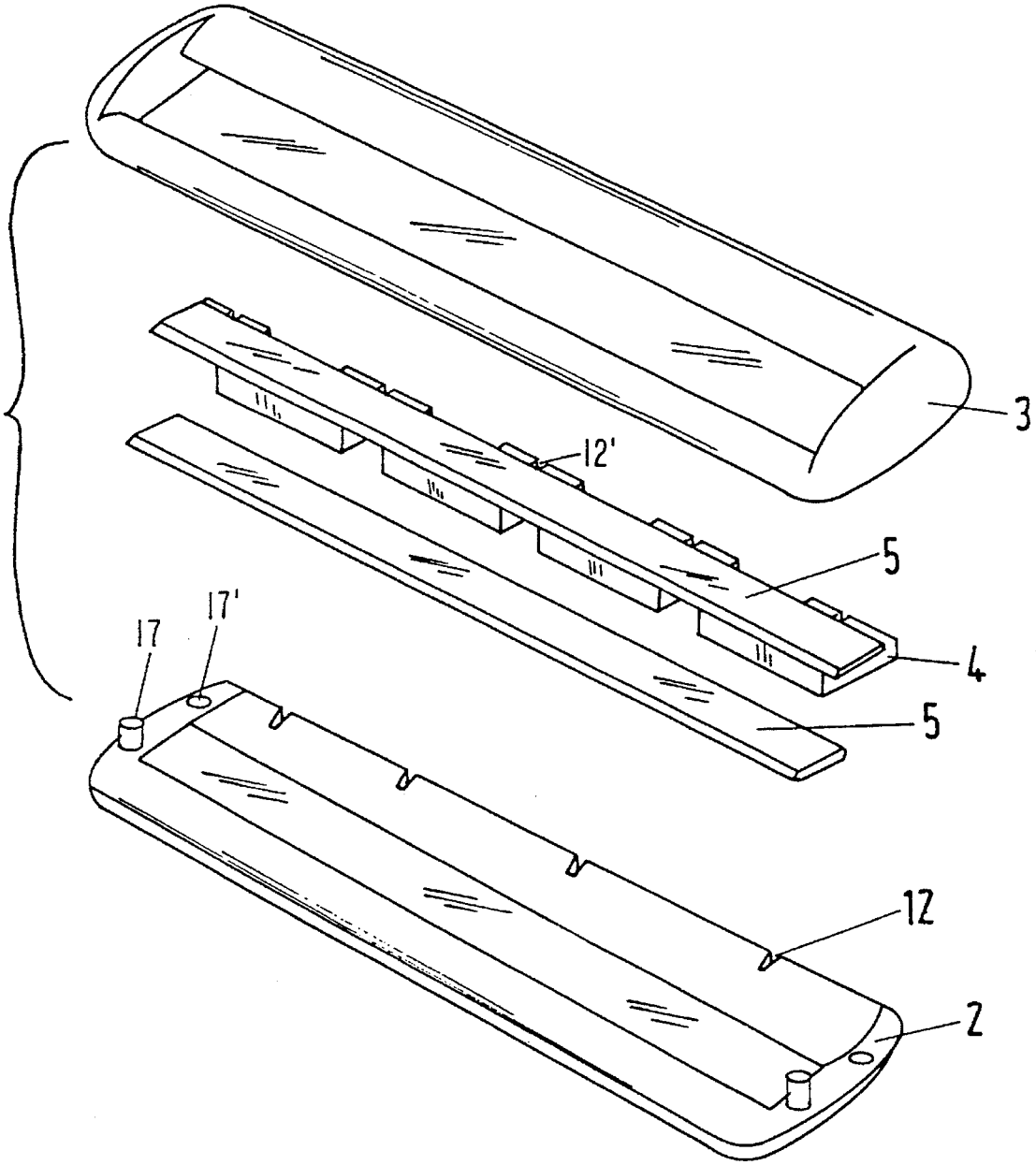
FIG. 2*a* is an exploded prospective view of the component parts of an inventive razor blade unit according to a modified embodiment of the invention.

The lower part 2 comprises V-shaped notches on its upper surface which are open at the rear side of the blade unit, opposite the blade edges. The spacer 4 also comprises V-shaped notches open to the rear side on both the upper and lower surfaces, as shown by way of example in FIG. 2*a*. In the illustrated embodiment, the notches 12' in the spacer 4 are similar to the notches 12 in the lower part 2, but could, of course, have any other desired configuration. Finally, the upper plastic part 3 comprises V-shaped notches on its under surfaces which are open to the rear side.

The components are assembled in position with respect to each other using a conventional pick and place automatic machine. At a first station the lower plastic part 2 is positioned in a nest on a moving conveyer. The nest then moves to a second station where the lower blade 5' is positioned on the lower plastic part 2. The nest then moves to a third station where the spacer 4 is positioned on the lower blade 5'. The nest is then moved to a fourth station where the upper blade 5 is positioned on the spacer 4. The nest is then moved to a fifth station where the upper plastic part 3 is positioned on the upper blade 5.

The nest is then moved to a sixth station where a restraining arm is pressed on the top of the upper plastic part 3. This clamps the five components and retains them in the required position. The nest is then rotated by 90° about an axis parallel to the length of the blade unit 1 such that the rear of the blade unit 1 is facing upwards. A predetermined amount of adhesive is then applied to the rear surface of the blade unit in the regions of the open ends of the V-shaped notches in the spacer and in the upper and lower plastic parts. The V-shaped notches form a well for the adhesive and by the action of gravity and capillarity forces the adhesive penetrates between the contacting surfaces of the five components.

The adhesive used is particularly adapted for penetration between the surfaces of the components and at the same time for bonding together of metal and plastic components. A particularly important property of the adhesive used is the viscosity because this property has a significant effect on the speed and extent of penetration which determines the even distribution of adhesive between the surfaces and consequently the strength of the bond achieved. The preferred adhesive is comprised of methyl or ethyl cyanoacrylate and has a viscosity lower than 100 milliPascals. For applications where the clamping pressure between the components is relatively high, and/or for use without indentations in the plastic surfaces, adhesives with lower viscosity values are required, for example less than 10 milliPascals.

Furthermore, the clamping pressure between the components when they are held together at the adhesive station has an effect on the degree of penetration of the adhesive between the surfaces. Too much clamping pressure will result in insufficient penetration of the adhesive, unless the adhesive is chosen with a sufficiently low viscosity. Similarly, too little clamping pressure will result in a risk of the components moving from the required relative positions.

Figure 3:
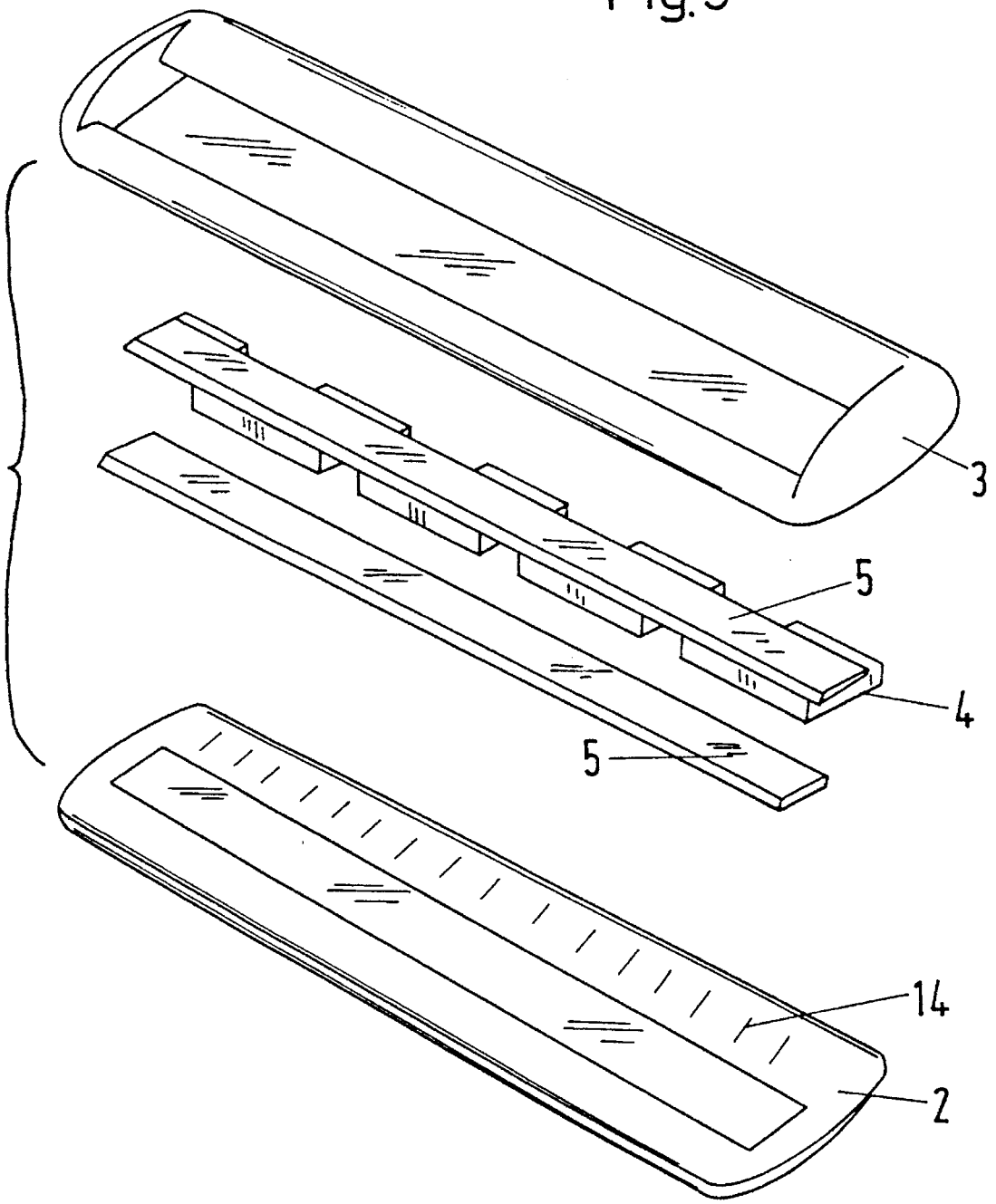
FIG. 3 is an exploded perspective view of the component parts of an inventive razor blade unit according to a further embodiment of the invention.

In a second embodiment of the invention as shown in FIG. 3, one or more of the contacting surfaces comprise a series of micro grooves 14. These grooves permit the penetration of adhesive to the entire surface which is to be bonded and also ensure an even and controlled thickness of adhesive on the surface.

The micro grooves could also be in the form of a random micro groove pattern achieved by having a coarse surface finish on the plastic parts. This can be achieved by texturing the mold surface or roller surface in the case of injection molded or extruded plastic parts respectively. The preferred range of size of the micro grooves is 1.5 to 175 micrometers thickness.

Figure 4:
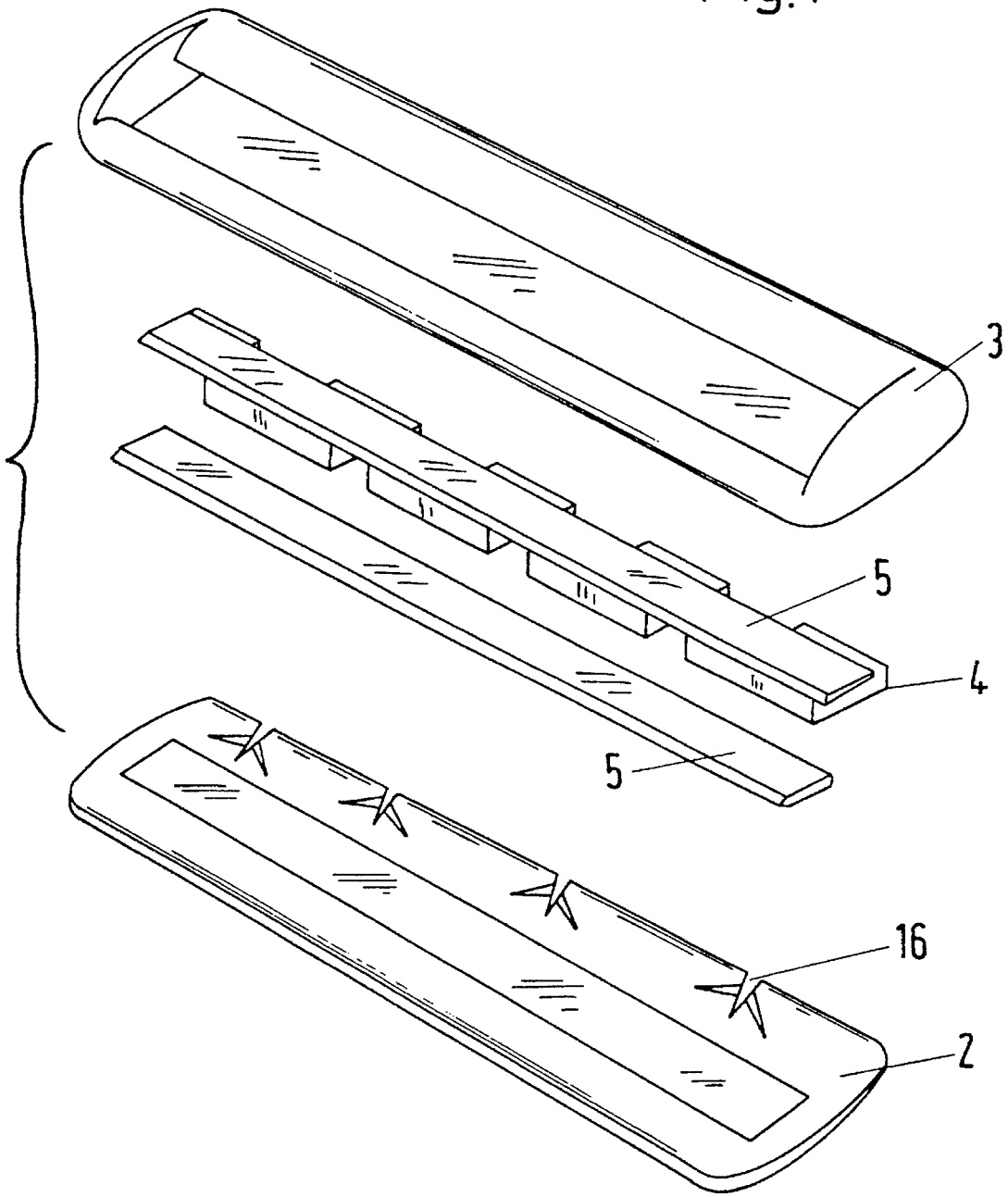
FIG. 4 is an exploded perspective view of the component parts of an inventive razor blade unit according to another embodiment of the invention.

In a third embodiment of the invention as shown in FIG. 4, one or more of the surfaces of the components to be bonded together comprise a pattern of grooves 16 which is arranged to ensure passage of the adhesive to all parts of the surface to be bonded.

In a further embodiment of the invention it is proposed that the surfaces of the components of the blade do not comprise any additional markings to the surfaces. The adhesive is applied at the adhesive stage to the rear side of the blade unit and is of a sufficiently low viscosity to penetrate between the surfaces. In a preferred embodiment of this method notches are provided in the rear edge of the spacer or other components to act as a well for the adhesive to prevent the adhesive running away from the required location before it has had time to penetrate between the surfaces.

In a fourth embodiment of the invention complementary detent means, for example complementary pins and holes 17, 17' (FIG. 2*a*), or other catch means, exist on the side walls of the upper and lower plastic parts which temporarily hold the five components together in the required positions. Such a hold is insufficiently strong for normal use of the blade unit because for safety reasons it is necessary to ensure that the blades do not, under any circumstances, become separated from the blade unit during use, transit or inadvertent damage to the blade unit. The temporary detented fixing means is therefore sufficient to hold the five components of the blade unit together until adhesive is applied at a separate adhesive station.

In this way it is possible to separate the assembly stage of production from the adhesive stage. This is beneficial in balancing the speeds of each operation and the frequency of stoppages. It is therefore possible to have two adhesive stations to one assembly station or three adhesive stations to two assembly stations or whatever the requirements are.

The present invention is, of course, in no way restricted to the specific disclosure of the specification and drawings, but also encompasses any modifications within the scope of the appended claims.

What I claim is:

1. A razor head for a wet razor, comprising:

a first plastic part;

a second plastic part;

a razor blade means disposed between said first plastic part and said second plastic part, said razor blade means comprising two razor blades and a spacer disposed between said blades, wherein at least one indentation is provided on at least one of said first plastic part, said second plastic part, and said spacer of said razor blade means for receiving adhesive.

2. A razor head according to claim 1, wherein said spacer is provided with an upper and a lower surface, with at least one of said surfaces being provided with at least one indentation for the application of adhesive.

3. A razor head according to claim 1, wherein said at least one indentation is in the form of a V-shaped notch that is open to a rear side of said razor head.

4. A razor head according to claim 1, wherein said at least one indentation is in the form of at least one micro groove.

5. A razor head according to claim 1, wherein said at least one indentation is in the form of interconnecting notches to permit penetration of adhesive.

6. A razor head according to claim 1, wherein said razor head includes temporary attaching means to retain said razor head in an assembled state prior to application of adhesive.

7. A razor head according to claim 6, wherein said attaching means comprise detents.

8. A razor head for a wet razor, comprising:

a first plastic part;

a second plastic part;

a razor blade means disposed between said first plastic part and said second plastic part, said razor blade means comprising two razor blades and a spacer disposed between said blades, wherein said first plastic part, said second plastic part, said spacer and said razor blade means are secured together by adhesive.

9. A razor head according to claim 8, wherein said adhesive is an ethyl or methyl cyanoacrylate.

10. A razor head according to claim 8, wherein said adhesive has a viscosity of less than 100 milliPascals.

11. A razor head according to claim 10, wherein said adhesive has a viscosity of less than 10 milliPascals.

* * * * *